US010815661B2

(12) United States Patent
Yaphe et al.

(10) Patent No.: US 10,815,661 B2
(45) Date of Patent: Oct. 27, 2020

(54) CANOPY INTERFACE FOR A CEILING MOUNT

(71) Applicant: AXIS LIGHTING INC.

(72) Inventors: Howard Yaphe, Lasalle (CA); Stephane Beland, Lasalle (CA); Andrew Miles, Lasalle (CA); Jean Gagne, Lasalle (CA)

(73) Assignee: Axis Lighting Inc., LaSalle (CA)

( * ) Notice: Subject to any disclaimer, the term of this patent is extended or adjusted under 35 U.S.C. 154(b) by 0 days.

(21) Appl. No.: 16/146,631

(22) Filed: Sep. 28, 2018

(65) Prior Publication Data

US 2019/0032333 A1 Jan. 31, 2019

Related U.S. Application Data

(63) Continuation of application No. 15/447,841, filed on Mar. 2, 2017, now abandoned.

(51) Int. Cl.

| | |
|---|---|
| ***E04B 9/06*** | (2006.01) |
| ***E04B 9/00*** | (2006.01) |
| ***E04B 9/18*** | (2006.01) |

(52) U.S. Cl.

CPC ..... *E04B 9/067* (2013.01); *E04B 9/006* (2013.01); *E04B 9/18* (2013.01)

(58) Field of Classification Search

CPC ..... E04B 9/067; E04B 9/10; E04B 9/14
USPC ..... 52/506.05
See application file for complete search history.

(56) References Cited

U.S. PATENT DOCUMENTS

| | | | | |
|---|---|---|---|---|
| 4,015,389 | A * | 4/1977 | Thompson | E04B 9/14 52/475.1 |
| 4,724,650 | A * | 2/1988 | Carey | E04B 9/14 52/650.3 |
| 5,537,304 | A * | 7/1996 | Klaus | F21S 8/04 362/147 |
| 6,345,800 | B1 * | 2/2002 | Herst | E04B 9/006 248/342 |
| 6,360,507 | B1 * | 3/2002 | Nevers | E04B 9/006 248/300 |
| 6,464,179 | B1 * | 10/2002 | Bulvan | H02G 3/20 248/317 |
| 6,637,710 | B2 * | 10/2003 | Yaphe | E04B 9/006 248/317 |
| 7,374,057 | B2 * | 5/2008 | Hendrickson | H02G 3/20 174/50 |
| 7,841,572 | B2 * | 11/2010 | Chen | A63H 33/006 248/284.1 |
| 8,057,077 | B2 * | 11/2011 | Gagne | F21V 21/02 362/147 |
| 10,233,640 | B1 * | 3/2019 | Russell | E04B 9/18 |

(Continued)

*Primary Examiner* — Paola Agudelo
(74) *Attorney, Agent, or Firm* — Barnes & Thornburg LLP

(57) ABSTRACT

A canopy for use with a ceiling connector mountable at a designated ceiling location to define a mounting end region thereon, includes a body securable to the mounting end region by a rotationally operable connector, wherein the body is configured to form a mounting interface with the mounting end region to block perceptible relative rotation therebetween about a rotation axis defined by the connector by forces associated therewith, wherein the mounting interface is defined by at least one first engagement surface on the canopy configured to be in contact with at least corresponding second engagement surface on the mounting end region.

6 Claims, 7 Drawing Sheets

(56) References Cited

U.S. PATENT DOCUMENTS

| | | | | |
|---|---|---|---|---|
| 2006/0260243 | A1* | 11/2006 | Angelozzi, Jr. | B25B 5/10<br>52/506.05 |
| 2014/0063776 | A1 | 3/2014 | Clark et al. | |
| 2015/0159824 | A1* | 6/2015 | Colan | F21S 8/043<br>362/191 |
| 2017/0074474 | A1* | 3/2017 | Bailey | F21S 8/04 |

* cited by examiner

CANOPY INTERFACE FOR A CEILING MOUNT

CROSS REFERENCE TO RELATED APPLICATIONS

This application is a Continuation of copending U.S. application Ser. No. 15/447,841, filed Mar. 2, 2017. The disclosure set forth in the referenced applications is incorporated herein by reference in its entirety.

FIELD OF THE DISCLOSURE

The present disclosure relates to light fixtures and other ceiling mountable articles.

BACKGROUND

Pendant light fixtures are those which are suspended from a structure, such as a fixture mounting harness, from a ceiling mounted junction box or the like. In the ubiquitous t-bar type ceiling configuration, for example, a t-bar connector is fastened to an individual t-bar and provides a convenient mounting location. A threaded member extends downwardly from the t-bar connector to couple with a mating threaded connector on the fixture mounting harness. A cover plate, called a canopy, is typically used to cover the coupling to provide a clean finish.

In some cases, the canopy is secured by a fastener which also supports the figure mounting harness, in which case the conventional canopy is prone to rotating relative to the t-bar. In most cases, such canopies are circular so that any tendency to rotate is not noticed. In other cases, where the canopy is not circular, additional time is needed time and effort to hold them in place, or to readjust them following installation.

It would thus be desirable to provide one or more approaches to address the above, or at least to provide the public with one or more useful alternatives.

SUMMARY

In an aspect, there is provided a ceiling connector assembly for mounting an article, comprising a ceiling connector configured to present an article-mounting end region below a downward facing ceiling surface. A canopy is provided for locating on the mounting end region and configured to cover, at least in part, the mounting end region in a covering position. The canopy and the mounting end region each have at least one first engagement surface and at least one second engagement surface respectively, wherein when the canopy is in the covering position, the first and second engagement surfaces form an interface to inhibit perceptible rotation of the canopy relative to the mounting end region.

Some exemplary embodiments may further comprise a locator associated with the ceiling connector and configured to receive a rotationally operable connector; the canopy including a centrally located passage to receive a portion of the locator, wherein the canopy is configured to be located between the mounting end region and the locator.

In some exemplary embodiments, the canopy further comprises at least one alignment member, the at least one first engagement surface is formed on the at least one alignment member to face a receiving zone to receive the mounting end region, thereby to form the interface with the at least one second engagement surface.

In some exemplary embodiments, the at least one alignment member includes a pair of alignment members on opposite sides of the receiving zone.

In some exemplary embodiments, at least one of the first and second engagement surfaces is configured to take up clearance therebetween when the canopy is in the covering position.

In some exemplary embodiments, the canopy is configured to accommodate a plurality of ceiling connectors of different sizes according to a first dimension, whiles each having a substantially common second dimension.

In another aspect, there is provided a kit comprising at least one ceiling connector and at least one canopy as defined in any aspect or exemplary embodiment herein.

In another aspect, there is provided a canopy for use with a ceiling connector mountable at a designated ceiling location to define a mounting end region thereon, comprising a body securable to the mounting end region by a rotationally operable connector. The body is configured to form a mounting interface with the mounting end region to block perceptible relative rotation therebetween about a rotation axis defined by the connector by forces associated therewith. The mounting interface is defined by at least one first engagement surface on the canopy configured to be in contact with at least corresponding second engagement surface on the mounting end region.

In some exemplary embodiments, the mounting end region includes a locator including fastening structure and the rotationally operable connector includes a complementary fastener to be engaged with the locator.

In some exemplary embodiments, the at least one first engagement surface is oriented transverse to the rotation axis.

Some exemplary embodiments may further comprise a back panel and a peripheral wall extending therefrom to form an inner region, the at least one first engagement surface located in the inner region and facing a receiving zone therein to engage at least one corresponding second engagement surface on the mounting end region.

Some exemplary embodiments may further comprise a pair of alignment members with corresponding first engagement surfaces on opposite sides of and facing a receiving zone to engage a corresponding pair of opposed second engagement surfaces on the mounting end region.

In some exemplary embodiments, the first engagement surfaces are inclined relative to the second engagement surfaces to take up clearance therebetween.

In some exemplary embodiments, the alignment members are configured to accommodate a plurality of ceiling connectors having a range of sizes according to a first dimension, while having a substantially common second dimension.

In another aspect, there is provided a canopy for covering a mounting end region on a ceiling connector, comprising a body with a central surface. A pair of alignment members is located thereon on opposite sides of a receiving zone to receive the mounting end region therein. A passage extends through the central surface to receive a rotationally operable connector associated with the mounting end region to define a rotation axis. The alignment members are configured to form an interface with the mounting end region to inhibit perceptible rotation of the canopy about the rotation axis by rotational forces associated with the connector upon operative installation on the mounting end region.

In another aspect, there is provided a canopy for covering a mounting end region on a t-bar connector, comprising a body with a central surface. A pair of alignment members is located thereon on opposite sides of a receiving zone to receive the mounting end region therein. A passage extends through the central surface to receive a threaded fastener associated with the mounting end region to define a rotation axis. The alignment members are configured to form an interface with the mounting end region to inhibit perceptible rotation of the canopy about the rotation axis by rotational forces associated with the fastener upon operative installation on the mounting end region.

In some exemplary embodiments, the alignment members are configured to take up clearance in the interface.

In some exemplary embodiments, the alignment members are configured to accommodate a plurality of t-bar connectors having a range of sizes according to a first dimension while having a substantially common second dimension.

Some exemplary embodiments may further comprise at least one mounting location laterally spaced from the rotation axis to engage an article-mounting harness or part thereof to support a pendant article thereunder.

BRIEF DESCRIPTION OF THE FIGURES

Several exemplary embodiments of the present disclosure will be provided, by way of examples only, with reference to the appended drawings, wherein.

DETAILED DESCRIPTION

Figure 1:
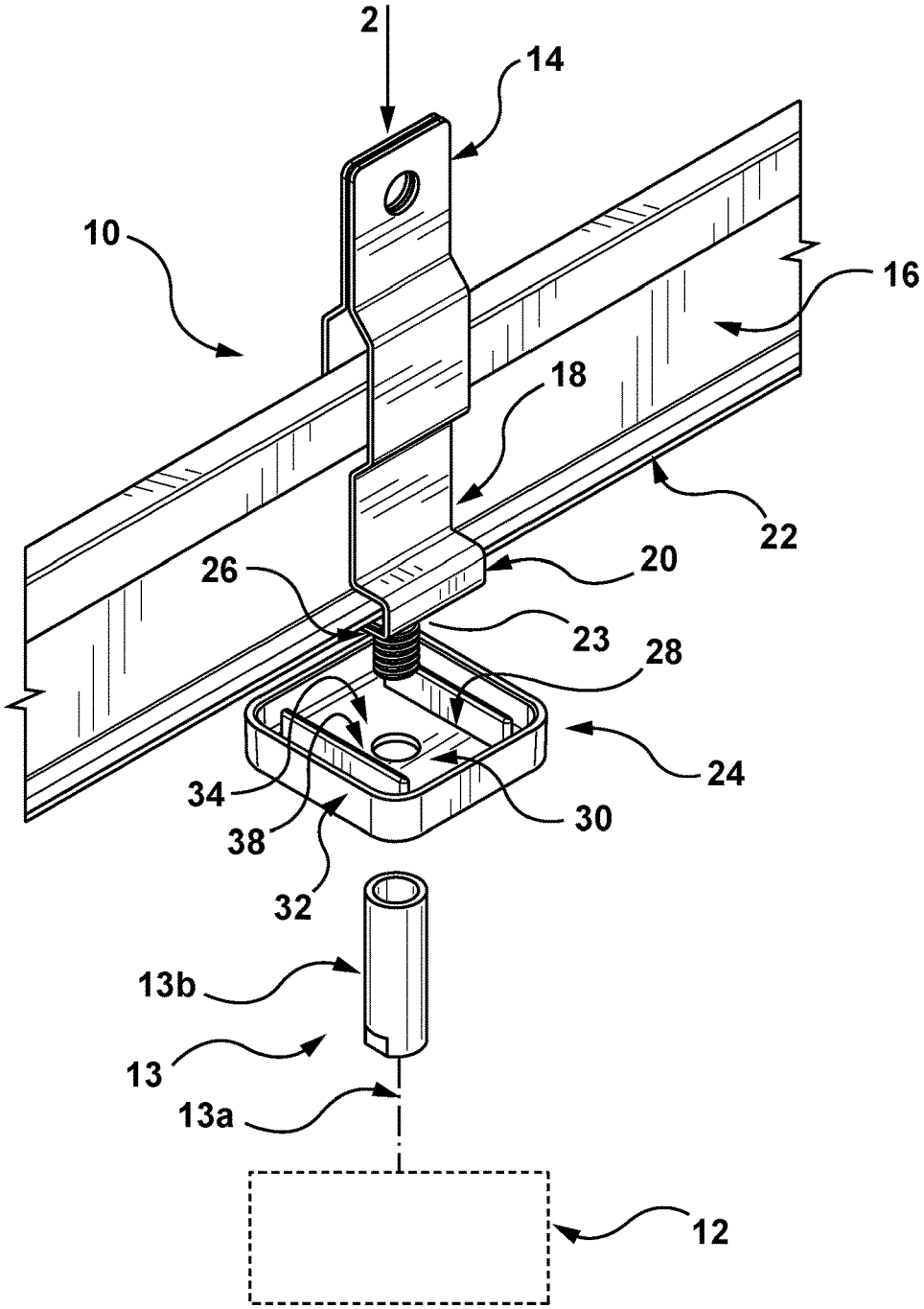
FIG. 1 is a schematic fragmentary perspective view of a ceiling connector assembly for a light fixture.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure.

The term "ceiling connector" means a connector which is configured to connect with a ceiling structure. Suspended ceilings are examples of such ceiling structures and include a grid of ceiling structural units called "t-bars". While reference is made below to t-bars, exemplary embodiments herein may be applied to other types of ceilings, such as those having grids formed from other ceiling structural units.

Referring to the figures, there is provided a ceiling connector assembly 10 which is configured to mount on a ceiling connector, for a light fixture (or other ceiling-mountable article) shown schematically at 12 suspended by a mounting harness 13, in this case with a cable 13*a* and a threaded cable connector 13*b*. In this case, the ceiling connector is in the form of a t-bar connector 14 is configured to mount on a t-bar 16 to form a t-bar connector body 18. The t-bar connector body 18 presents an article-mounting end region 20 or mounting end region 20 adjacent an exposed downward facing surface 22 of the t-bar 16 (FIG. 3), for mounting the light fixture 12 thereto. The mounting end region 20 includes a passage 21 (FIG. 5) to receive a locator, in this case including a post 23, in this case with a fastening structure in the form of threads, and which in turn is configured to receive the threaded cable connector 13*b* or other fastener. While a threaded fastening structure is used in connecting the cable connector 13*b* to the threaded post 23, other configurations of fastening structures, such as other rotationally operable non-threaded fastening structures are within the scope of the present disclosure.

Figure 1A:
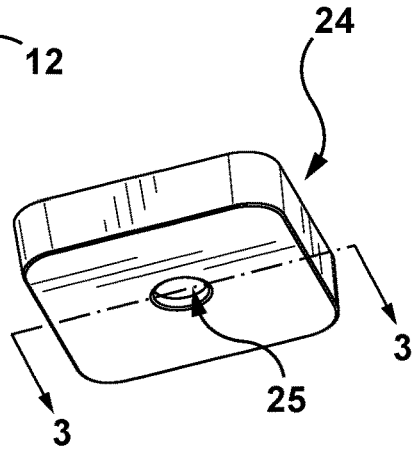
FIG. 1*a* is a perspective view of a component of the assembly of FIG. 1.
Figure 3:
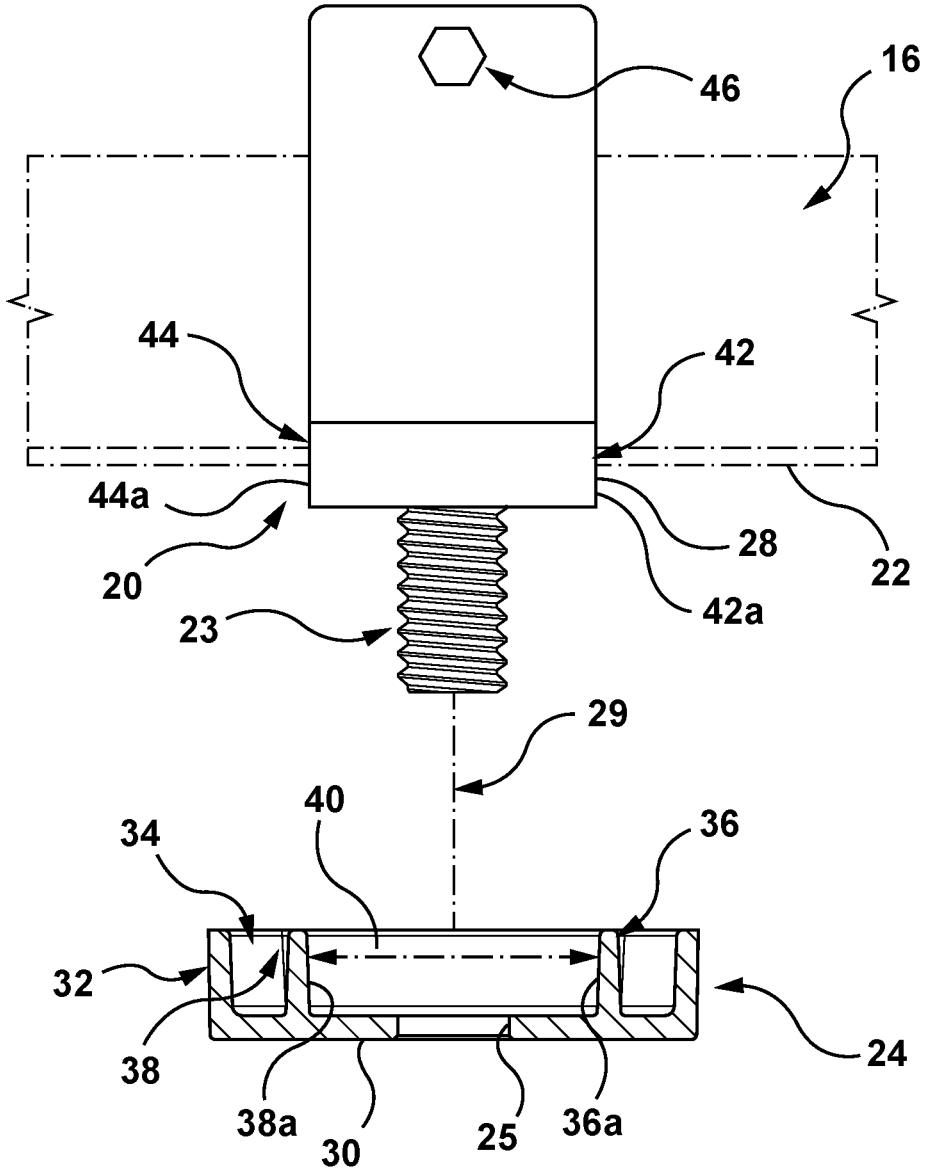
FIGS. 3 and 4 are successive schematic, part-sectional views of the assembly in different assembly positions, with the sectioned portions taken on line 3-3 of FIG. 1*a;*
Figure 4:
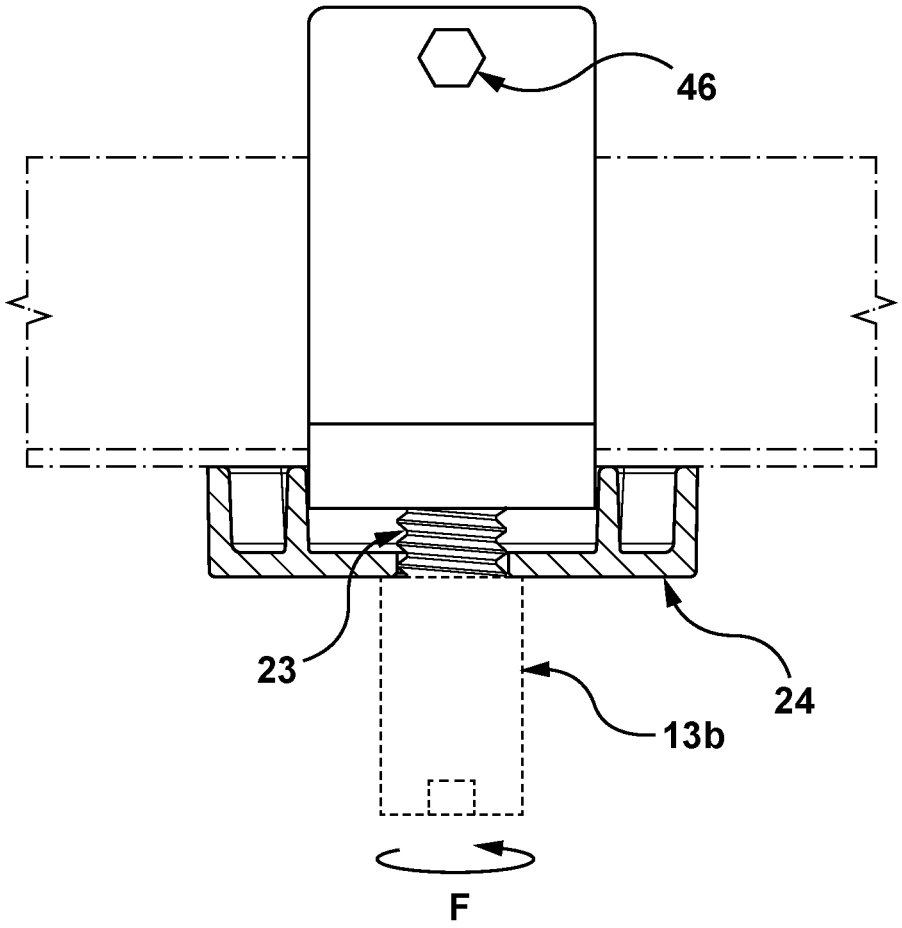

FIGS. 3 and 4 show the threaded post 23, with FIG. 4 showing the post in threaded engagement with the threaded cable connector 13*b*, as will be described. In this case, a canopy 24 is shown in section taken along line 3-3 of FIG. 1*a*, which presents passage 25 to receive the threaded post 23.

The canopy 24 is provided for covering the mounting end region 20 in a covering position (FIG. 4) when in position on the ceiling formed in part by the t-bar 16 and associated ceiling panels or the like, not shown. As will be described, the canopy 24 and mounting end region 20 have respective first and second engagement surfaces which, when the canopy 24 is in the covering portion, inhibits or minimizes a perceptible rotation of the canopy 24 about a rotation axis 29 relative to the mounting end region 20, beyond a designated angular position, that is a rotation to an extent that a nearby consumer may perceive the canopy as being inconsistently misaligned, for example, with the exposed surface 22 of the associated t-bar 16, for example from one canopy to the next in an array of canopies.

For instance, in the exemplary embodiment represented by canopy 24, a designated angular position may be one with a zero included angle, that is where the canopy has an axis, a side surface, or in this case a pair of opposed parallel side surfaces which are parallel with the t-bar 16, or otherwise locally in-line with the t-bar where the t-bar may be curvilinear or the like.

Figure 2:
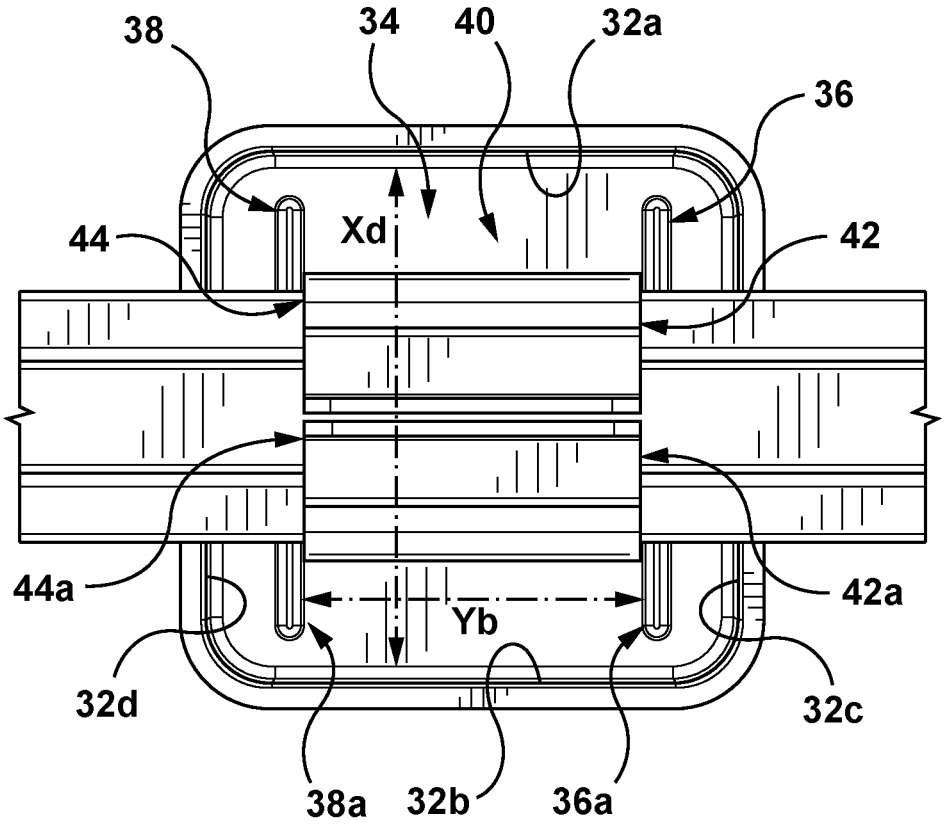
FIG. 2 is a plan view taken on arrow 2 of FIG. 1.
Figure 2A:
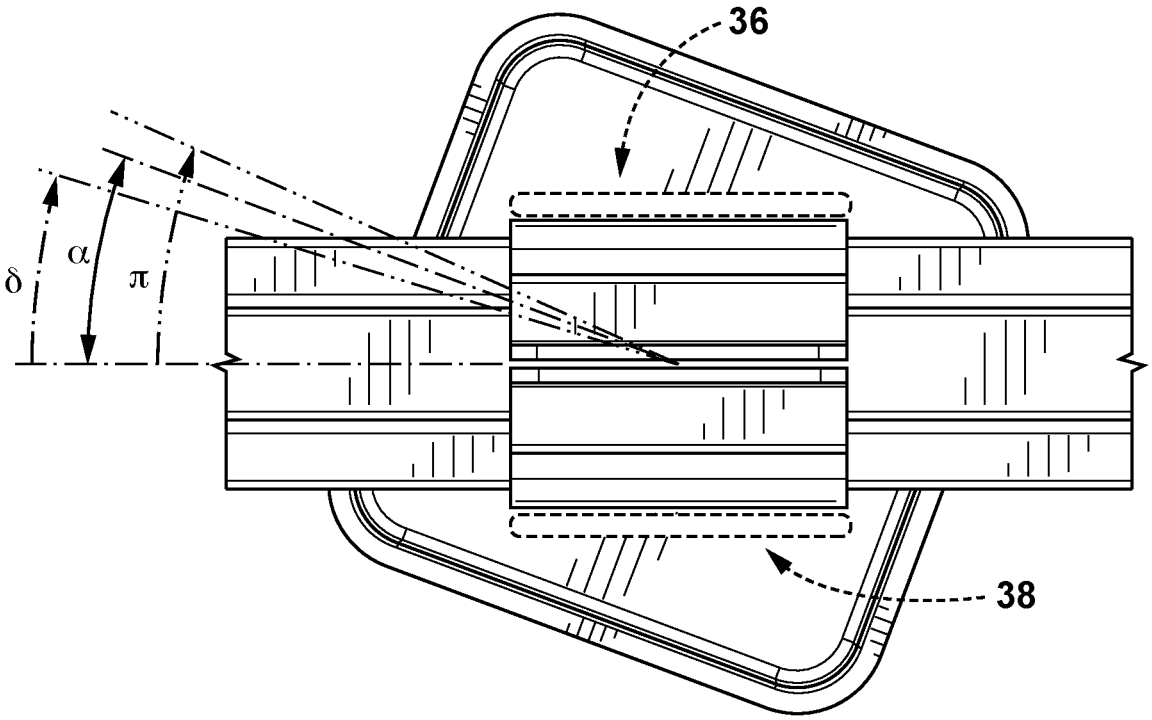
FIG. 2*a* is a plan view of another ceiling connector assembly.

Alternatively, in the exemplary embodiment shown in FIG. 2*a*, the designated angular position is defined by a non-zero included angle $\alpha$ and may apply to installations where a designated angular offset is part of a particular pendant installation which may be a design feature in addition to, or in combination with, design features in an adjacent ceiling structure, including the t-bar 16.

In some exemplary embodiments, as shown in FIG. 3, the canopy 24 further comprises a back panel 30 and a peripheral wall 32 extending therefrom to form an inner region 34, thus providing a concave or cup-like shape or configuration, though other shapes and configurations may also be deployed as desired.

In some exemplary embodiments, as best seen in FIG. 3, at least one, in this case two alignment members 36 and 38 are positioned in the inner region 34 on opposite sides of a central passage 25 which receives threaded post 23. First engagement surfaces 36*a*, 38*a* are formed on alignment members 36, 38, with each facing a receiving zone 40 defined therebetween, to receive at least a portion of the mounting end region 20. The mounting end region 20 provides at least one, in this case an opposing pair, of the second engagement surfaces 42*a*, 44*a* in opposed peripheral regions 42, 44 thereon, to locate adjacent the corresponding first engagement surfaces 36*a*, 38*a*. The alignment members 36, 38 are, in this instance, transverse to the rotational axis 29 and are configured to abut the opposed peripheral regions 42, 44 at the interface formed by first and second engagement surfaces, which has the effect of blocking perceptible relative rotation of the canopy 24 relative to the about mounting end region 20 about the rotational axis 29.

Figure 5:
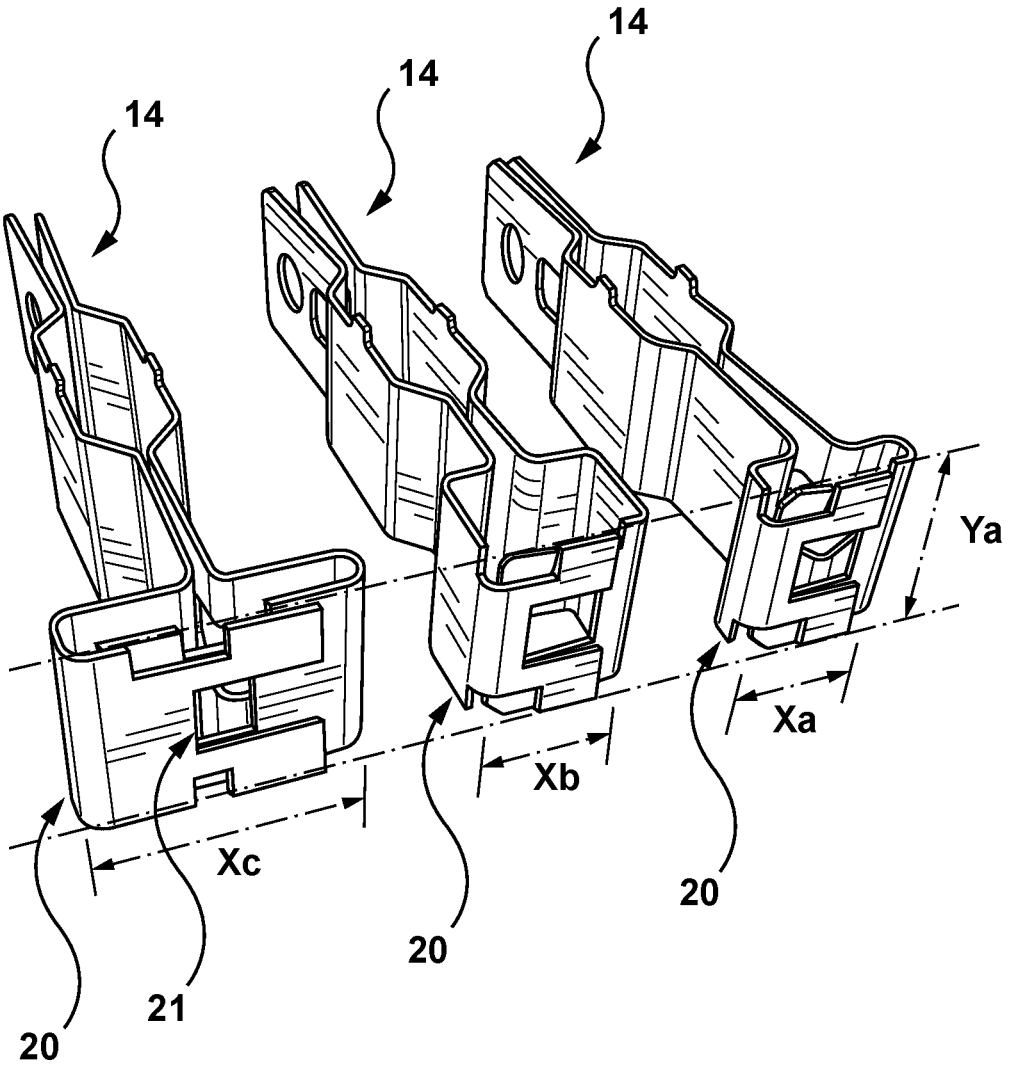
FIG. 5 is a perspective view of three ceiling connectors for alternative use in the assembly of FIG. 1.

FIG. 5 shows three exemplary embodiments of t-bar connectors 14, for three different t-bar configurations, which may be used with the same canopy, that is by having three corresponding mounting regions 20 with different "x" dimensions Xa, Xb and Xc but with a substantially common "y" dimension Ya. Thus, as best seen in FIG. 2, the canopy 24 may be configured which has a distance Yb between the first engagement surfaces 36*a*, 38*a* which is operably equivalent to Ya to provide an operable engagement between the mounting end region 20 and the canopy 24 and yet accommodate a range of mounting end regions 20 with different x dimensions Xa, Xb and Xc, provided that they do not exceed the distance Xd between the corresponding inner surfaces 32*a*, 32*b* of the peripheral wall 32. Thus, the canopy 24 is configured to accommodate t-bar connectors of different sizes in an X direction while having a substantially common Y dimension.

The canopy 24 may be provided in a kit of one or more such canopies and one or more t-bar connectors along with instructions for installation. The canopy 24 also may be provided in a package as part of mounting hardware for a light fixture or other pendant article, which may include wiring harness(es), cable(s), chain(s) and the like.

To prepare the t-bar connector assembly 10, the t-bar connector 14 is first installed on the t-bar 16 by fastener 46 (FIG. 3) to form the mounting end region 20. The canopy 24 is then oriented so that the first engagement surfaces 36*a*, 38*a* are in-line with the corresponding second engagement surfaces 42*a*, 44*a*. This can be, for instance, achieved by visually aligning the corresponding outer surfaces of the canopy with the t-bar itself, if the canopy is rectangular shaped, as in this exemplary embodiment.

In some exemplary embodiments, the canopy may be of other non-rectangular shapes, such as circular or triangular, in which case the alignment of the first and second engagements may be facilitated in other ways (but not necessarily required), such as by visually aligning the engagement surfaces on the canopy's approach to the mounting end region, or providing a visual indication of the orientation of the first engagement surfaces, such as by a reference line or arrow on the exposed surfaces that would not be visible to a nearby consumer, among other options.

The canopy 24 may be then located with the threaded post 23 extending through passage 25. The mounting harness 13 may then be installed on the threaded post 23. In some exemplary embodiments, the canopy 24 may be installed and held in place by way of a fastener which is separate from an associated mounting harness for a pendant light fixture or other article to be attached to the connection assembly, or otherwise integral therewith, as is the case with cable connector 13*b*.

Tightening the cable connector 13*b* may tend to deliver a rotational force F to the canopy 24 that might otherwise tend to cause the latter to rotate about the rotation axis 29 to an extent causing a perceptible rotation by a nearby consumer.

Figure 4A:
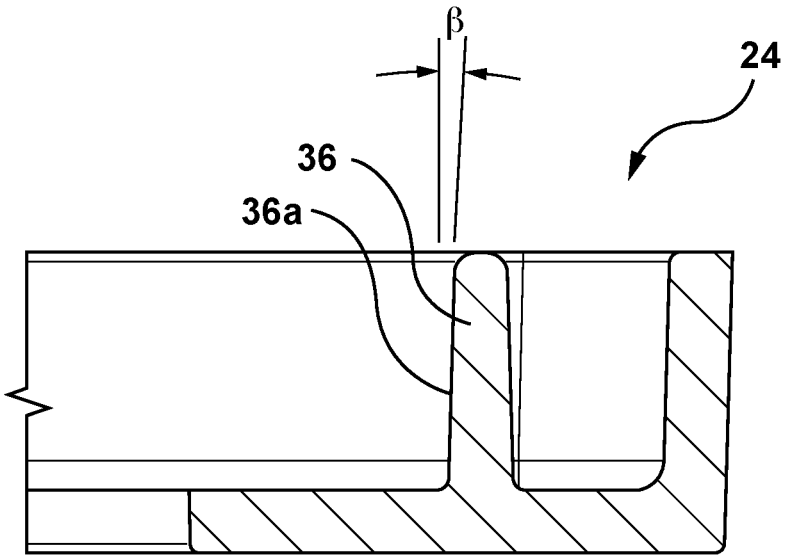
FIG. 4*a* is a magnified fragmentary sectional view taken on line 3-3 of FIG. 1*a;*

However, in the case of the assembly 10, the interface formed by the first and second engagement surfaces 36*a*, 38*a*, 42*a* and 44*a* blocks such rotational movement of the canopy 24 since the alignment members 36 and 38 are prevented from rotation beyond that afforded by clearance between the opposed first and second engagement surfaces. Further, as shown in FIG. 4*a*, for the alignment member 36, the alignment members 36, 38 may be upwardly tapered in cross section, thus making the first engagement surfaces 36*a* and 38*a* slightly inclined outwardly off vertical, as shown by angle β. Meanwhile, the second engagement surfaces 42*a*, 44*a* may be formed, as in this exemplary embodiment, to be substantially parallel. Thus, the tapering of the first engagement surfaces 36*a*, 38*a* may allow for clearance between the first and second engagement surfaces to be taken up as the canopy is positioned on the mounting end region 20, to further remove or at least reduce incidental rotational play that may otherwise be present by the noted clearance. In the alternative, one or both of the second engagement surfaces may be inclined relative to the first engagement surfaces to take up the clearance. Still further, both the first and second engagement surfaces may be provided with inclined surfaces or other configurations to take up clearance therebetween to block the rotation of the canopy 24 relative to the mounting end region.

While the canopy 24 is provided with a pair of alignment members 36 and 38 which are inwardly spaced from the peripheral wall 32 to provide the first engagement surfaces 36*a*, 38*a* and to define the receiving zone 40 therebetween, other configurations may be employed, such as by providing at least one (in this case two) the first engagement surface(s) on corresponding inner regions of the peripheral wall 32 to match a configuration of a corresponding mounting end region. For example, Yb may extend to the surfaces 32*c*, 32*d* on the peripheral wall 32 (FIG. 2). In this case, the Xd may be equal therewith to match a square configured mounting end region 20, or be a longer dimension to accommodate a number of possible mounting end regions 20 in a similar manner to the current illustrated configuration of Yb and Xd of FIG. 2.

Figure 6A:
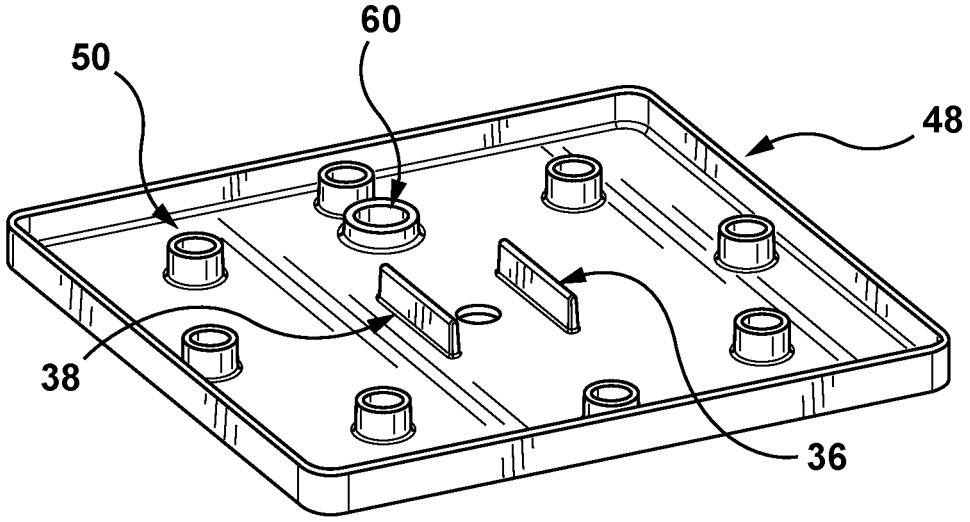
FIG. 6*a* is a downward perspective view of another component in a ceiling connector assembly.
Figure 6B:
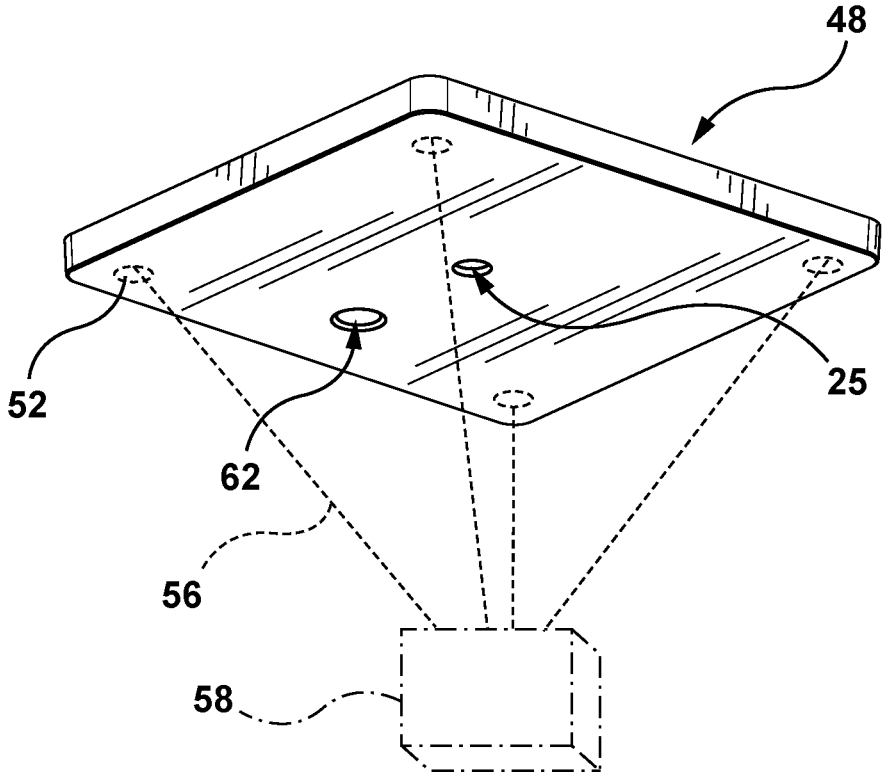
FIG. 6*b* is an upward perspective schematic view of the component of FIG. 6*a*.

In some exemplary embodiments, the blocking function of the first and second alignment members may be provided in a number of forms and configurations to interrupt the rotation of the canopy, which also may be provided in different forms and configurations, such as the relatively larger canopy 48 in FIGS. 6*a* and 6*b* which may provide other features, in this example passage formations 50 with punch out openings to provide passages 52 to receive supports, such as shown schematically at 56, to carry a pendant light fixture other pendant article such as a fan, speaker, video display, or the like shown schematically at 58, and/or an electrical cord receiving passage formation 60 providing opening 62. The first and second alignment members 36, 38 may include a single instance of both or more than two, as desired, with the passage 25 provided to receive a threaded post 23 or the like with a fastener connected thereto to position the canopy 48 in the covering position.

Thus, referring again to FIG. 2*a*, a canopy may be provided with one or more alignment members 36, 38, or other configurations to designate an angular position relative to a reference axis of the t-bar or another feature or aspect of a ceiling formed thereby, or an a pendant article supported thereunder. Thus, the designated angular position may be in-line, that is with included angle α being zero, or a designated offset angle with the included angle α being non-zero. The canopy may thus be provided for use in groups of more than one, where each canopy is configured to provide a common included angle α, where the canopies will, when installed, complement a design approach with a number of pendant article locations and/or a ceiling configuration. Alternatively, such canopies in the group can be provided in sub-groups, each with different included angles α to present alternative design configurations for a number of pendant article locations and/or ceiling configurations. For instance, the canopies may provide first and second included angles α, to form first and second rows of light fixture locations with the first row having a positive included angle α and the second having a negative included angle α, or first and second angles non-equal positive angles, as two examples. In each case, the canopy may thus provide that rotation of the canopy from the designated included angle α does not exceed one that would otherwise cause a perceptible misalignment from the designated included angle α between, such as for instance a misalignment caused by a misaligned angle of more (or less) than 5 degrees, such as represented by included angles π and δ when compared to designated angle α.

The covering, at least in part, by canopy 25 includes a complete or partial covering of the mounting end of the mounting end region 20, which may include coverings in which expose part of the mounting end region 20, where it is provided with one or more design features that are intended to be viewed when both the canopy 25 and the mounting end region 20 are assembled. There may other configurations where the canopy may be configured to present the mounting end region while providing the designated angular position.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A ceiling connector assembly for mounting an article, comprising a ceiling connector having an article-mounting end region configured to present the article-mounting end region below a downward facing ceiling surface, a canopy for locating over the article-mounting end region and configured to cover, at least in part, the article-mounting end region in a covering position, the canopy having a back panel with a periphery, a peripheral wall extending along the periphery to form an inner region, a pair of opposed first engagement surfaces spaced from the peripheral wall and located in the inner region and facing a receiving zone therein to engage a corresponding pair of opposed second engagement surfaces on the mounting end region, wherein when the canopy is in the covering position, the first engagement surfaces on the canopy engage corresponding second engagement surfaces on the article-mounting end region to inhibit rotation of the canopy relative to the article-mounting end region.

2. The assembly of claim 1, further comprising a locator associated with the ceiling connector and configured to receive a rotationally operable connector; the canopy including a centrally located passage to receive a portion of the locator, wherein the canopy is configured to be located between the article-mounting end region and the locator.

3. The assembly of claim 2, wherein the canopy further comprises includes a pair of alignment members on opposite sides of the receiving zone, each first engagement surface formed on a corresponding alignment member to face a receiving zone to receive the article-mounting end region, thereby to form the interface with the at least one second engagement surface.

4. The assembly of claim 3, wherein at least one of the first and second engagement surfaces is configured to reduce clearance therebetween when the canopy is in the covering position.

5. The assembly of claim 1, wherein the canopy is configured to accommodate a plurality of ceiling connectors of different sizes according to a first dimension, with each having a substantially common second dimension.

6. A kit comprising at least one ceiling connector and at least one canopy as defined in claim 1.

* * * * *